US005692606A

United States Patent [19]

Elmaleh

[11] Patent Number: 5,692,606

[45] Date of Patent: Dec. 2, 1997

[54] COMPACT HOSIERY PACKAGING

[76] Inventor: Daphne Elmaleh, 38 Hartman Rd., Newton, Mass. 02159

[21] Appl. No.: 624,648

[22] PCT Filed: Aug. 31, 1994

[86] PCT No.: PCT/US94/09637

§ 371 Date: Apr. 15, 1996

§ 102(e) Date: Apr. 15, 1996

[87] PCT Pub. No.: WO95/10451

PCT Pub. Date: Apr. 20, 1995

[30] Foreign Application Priority Data

Oct. 15, 1993 [IL] Israel ..... 107297

[51] Int. Cl.[6] ..... B65D 85/18

[52] U.S. Cl. ..... 206/278; 53/429; 53/438; 53/469

[58] Field of Search ..... 206/278; 53/129, 53/429, 438, 439, 469, 530

[56] References Cited

U.S. PATENT DOCUMENTS

| | | | |
|---|---|---|---|
| 2,561,112 | 7/1951 | Hahn | 206/278 |
| 3,193,137 | 7/1965 | McCarthy et al. | 206/278 |
| 3,209,511 | 10/1965 | Pournier | 53/429 |
| 3,252,567 | 5/1966 | Baron et al. | 206/278 |
| 3,273,363 | 9/1966 | Spohr | 53/429 |
| 3,514,019 | 5/1970 | Glaze, Jr. et al. | 223/1 |
| 3,704,565 | 12/1972 | Glaze, Jr. | 53/21 |
| 3,902,300 | 9/1975 | Glaze, Jr. | 53/21 |
| 4,881,358 | 11/1989 | Berg | 53/429 |
| 4,922,685 | 5/1990 | Hodges | 53/429 |
| 4,972,650 | 11/1990 | Egea et al. | 53/429 |
| 5,042,227 | 8/1991 | Merry | 53/438 |
| 5,230,202 | 7/1993 | Propach et al. | 53/429 |

*Primary Examiner*—Stephen P. Garbe
*Attorney, Agent, or Firm*—Everett G. Diederiks, Jr.

[57] ABSTRACT

A packaging arrangement for compacting a hosiery item (4) having an associated uncompressed loose density within a storage chamber (9) of a packaging container (2) to a compressed density corresponding to 2 to 12 times and preferably 3 times the associated uncompressed loose density is provided by applying a compressive force to the hosiery item (4) between 1.4 to 3.5 kg/cm$^2$ (20–50 psi) within the package (2). Compressing the hosiery item (4) to this degree enables a compact hosiery package (2) to be formed while assuring that the hosiery item (4) will readily assume its uncompressed state as soon as the package (2) is opened. The invention is equally applicable to various types of hosiery items, including pantyhose, stockings and the like.

20 Claims, 10 Drawing Sheets

COMPACT HOSIERY PACKAGING

BACKGROUND OF THE INVENTION

1. Field of the Invention

The present invention pertains to the art of textile packaging and, more particularly, to the compact packaging of hosiery.

2. Discussion of the Prior Art

Hosiery, such as pantyhose and stockings, commonly found in today's marketplace are formed of delicate woven or knitted material. Due to the delicate nature of the material used to form various hosiery items, it is extremely common for these items to tear or "run". For that reason, it is common practice for women wearing pantyhose, for example, to carry an extra or spare pair. Unfortunately, pantyhose are rather bulky even in their packaged form. Generally, pantyhose, as well as other hosiery items, are packaged within either a sealed bag or in a two-piece container. Due to the bulky nature of these packaged items, it is generally considered cumbersome to carry a spare, particularly a spare pair of pantyhose, even in a handbag. However, due to the potential need for the auxiliary hosiery item, a spare is still generally retained by many women.

In view of the relatively bulky nature of known hosiery packages, there exists a need to reduce the necessary package size of a hosiery item, particularly in the case of a pair of pantyhose, in order to enable the package to be conveniently carried in a handbag or even a clothes pocket. Obviously, reducing the size of the package achieves additional advantages as well. For example, the need for less packing material can result in lower transportation and manufacturing costs.

The concept of minimizing the packaging size of textiles and the like is known in the art. For example, it is common to vacuum seal articles within packages in order to minimize the size of the package. An example of such a system is disclosed in U.S. Pat. No. 2,764,859. It is also known in the art to compress various textile articles in order to obtain a compact product. For example, U.S. Pat. No. 5,042,227 discloses a method and apparatus for compression packaging sheet articles. In one exemplary embodiment disclosed in this patent, pantyhose are compressed within a mold at an elevated pressure in the range of 2,800 —3,100 PSI for a predetermined time. The pressure and time are selected such that the pantyhose are compressed to form a stable, substantially rigid, compacted article which retains substantially the shape of the mold after it is removed therefrom. The article can then be placed in a suitable package for handling, storage and transportation. In accordance with this known prior art, the compressed article can be returned to its original, uncompressed condition by pulling loose edges or comers of the article. In addition, water can be used to aid in expanding the compressed article.

Unfortunately, this known prior an arrangement, although perhaps successful in compressing and packaging various sheet articles, can be extremely damaging to delicate fabrics such as those used to make pantyhose. In fact, given the degree of care necessary to return the compressed pantyhose back to its original uncompressed state without damaging the pantyhose, this can be a very time consuming task and can often result in actual damage to the pantyhose. Another drawback of the packaging arrangement disclosed in the '227 Patent is that the compressed article has to be generally placed in a waterproof package since the infusion of water into the compressed article can cause an untimely expansion of the compressed article. For this reason, additional manufacturing costs will be incurred in order to provide such a sealed package.

Therefore, as indicated above, there exists a need in the art for a packaging arrangement for hosiery items, in particular pantyhose, wherein each item can be housed in a compact package which can be readily and conveniently carried in a handbag, clothes pocket or the like. In addition, there exists a need in the art for a hosiery packaging arrangement which does not increase the likelihood of damage to the item as it is either compressed into a compact and packaged state or uncompressed to a usable form. It is also highly desirous to provide a packaging arrangement for hosiery wherein the hosiery can be packaged in an extremely compact manner, but which will readily assume its uncompressed state upon opening of the packaging.

SUMMARY OF THE INVENTION

It is the object of the present invention to provide a packaging arrangement for hosiery items, in particular pantyhose, which is compact in nature such that the package can be readily and conveniently carded in a hand bag or clothes pocket and wherein, once the package is opened, the hosiery item will readily assume a relaxed, uncompressed state. This object of the invention is achieved by compacting a hosiery item having an associated uncompressed loose density within a storage chamber of a packaging container to a compressed density corresponding to 2 to 12 times, and preferably 3 to 6 times, the associated uncompressed loose density. Compressing the hosiery item to this particular degree assures that the item will readily assume its uncompressed state as soon as the package is opened. Various ways in which hosiery items can be packaged in this manner are also disclosed. In general, these packaging arrangements are designed to apply a compressive force to the hosiery item of between 1.4 to 3.5 kg/cm$^2$ (20 to 50 psi) in order to achieve the desired compression ratio while assuring that the delicate material used to form these items is not damaged.

Additional objects, features and advantages of the present invention will become more readily apparent from the following detailed description of various preferred embodiments, when taken in conjunction with the drawings wherein like referenced numerals refer to corresponding parts in the several figures.

DETAILED DESCRIPTION OF THE PREFERRED EMBODIMENTS

Figure 1:
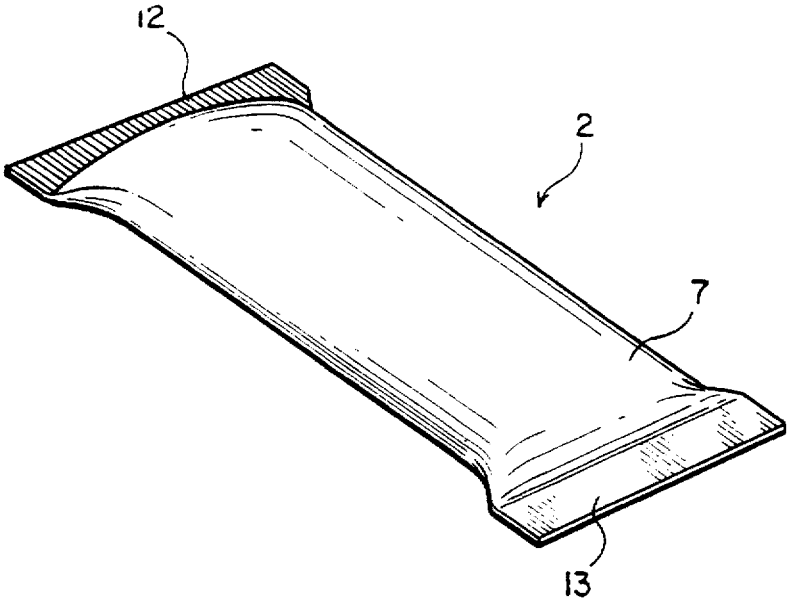
FIG. 1 is a perspective view of a preferred packaging arrangement for a hosiery item in accordance with the present invention.

With initial reference to FIGS. 1–3, a preferred packaging arrangement, generally indicated at 2, for a hosiery item 4 will now be described. Package 2 includes an elongated tubular main container body portion 7 that defines a storage chamber 9 between two sealed ends thereof 12, 13. In the embodiment shown, hosiery item 4 constitutes a pair of pantyhose. As will be described more fully below with reference to various apparatuses and methods for packaging hosiery item 4 within package 2, hosiery item 4 is adapted to be placed in storage chamber 9 with end 13 of package 2 already sealed and then a compressive force of between 20 to 50 psi as applied to the hosiery item 4 followed by sealing of end 12 of package 2. By this arrangement, the density of hosiery item 4 is increased from within a preferred range of 3 to 6 times an uncompressed loose density associated with hosiery item 4 when it is in a relaxed state outside of package 2. It has been found that packing hosiery items in this manner assures the integrity of the delicate material from which the hosiery items are made while advantageously presenting a compact hosiery package that will enable the hosiery item to readily assume an uncompressed and usable state once package 2 is opened.

Figure 2:
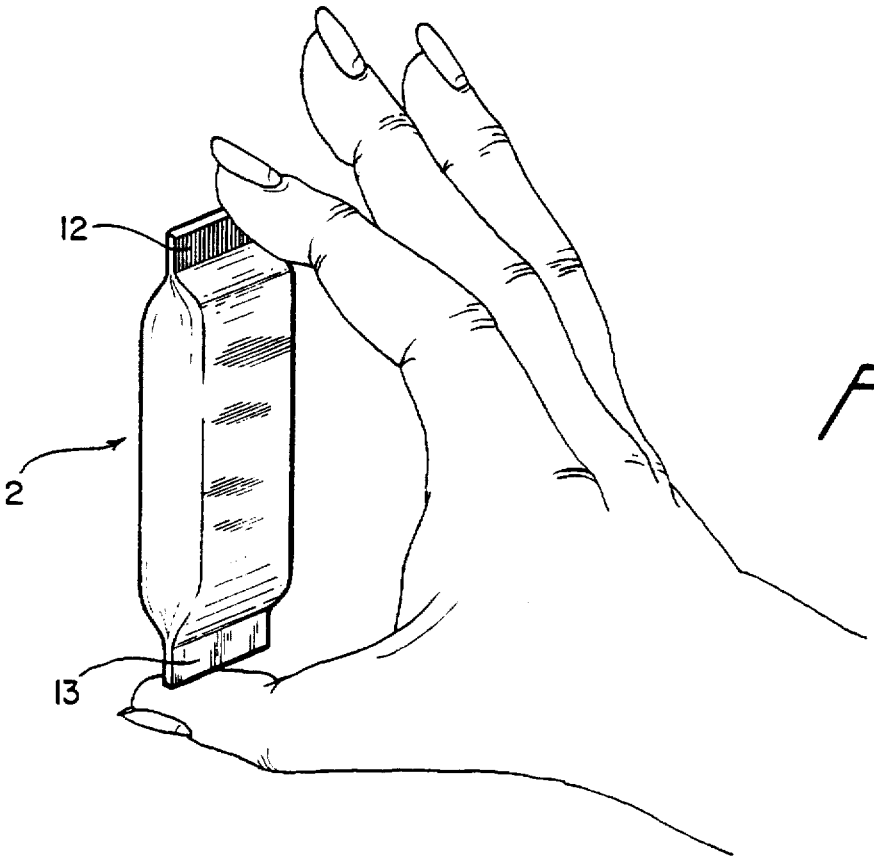
FIG. 2 is a perspective view of the packaging arrangement of FIG. 1 illustrating the relative size of the package.
Figure 3:
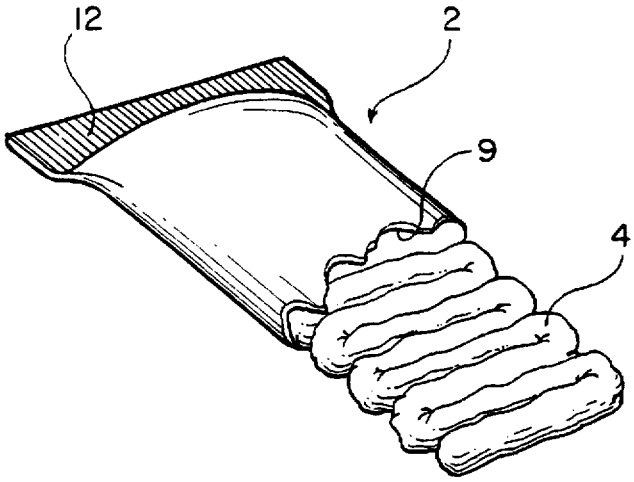
FIG. 3 is an exploded view of the package illustrated in FIG. 1.

When package 2 is used in connection with a pair of pantyhose and compressed in the manner briefly discussed above, package 2 is sized relative to an average woman's hand as illustrated in FIG. 2. For example, in accordance with the preferred embodiment of the invention wherein a pair of pantyhose of between 10–20 denier whose weight is between 10 to 20 grams is packaged in accordance with the present invention as shown in FIG. 2, package 2 will have an associated preferred longitudinal length of approximately 5–10 cm, a preferred diameter of approximately 1.5–4 cm and a central circumference of approximately 4–9 cm depending upon the size (small to extra large) of the pantyhose. Although package 2 can be formed of various materials including numerous thermoplastic materials, package 2 is preferably formed from a biodegradable material such as cardboard. When using cardboard as the material for package 2, in order to adequately maintain the integrity of package 2 when hosiery item 4 is compressed therein, it has been found that the thickness of the cardboard should be in the range of approximately paper thin to 3 mm. Ends 12 and 13 are preferably sealed by means of adhesive and have widths of approximately 0–15 cm such that ends 12 and 13 can add from 0–3 cm to the overall length of package 2. Obviously this distance to the length of package 2 that is added by ends 12 and 13 does not add to the size of storage chamber 9.

It should be understood that the volume of storage chamber 9 and the particular size of package 2 will vary depending upon the particular size and kind of hosiery item 4 that is compressed therein. For the sake of completeness, it has been found that a folded uncompressed pair of pantyhose, from a small size to an extra large size, has an associated volume ranging between 120–240 $cm^3$. Such pantyhose can evince a compressed volume in accordance with the present invention of between 20–100 $cm^3$ but preferably between 30–60 $cm^3$. In other terms, a folded uncompressed pair of pantyhose having an associated density ranging from 0.05–0.12 $g/cm^3$ are compressed and packaged in accordance with the present invention to a density range of 0.15 to 0.8 $g/cm^3$ and preferably between 0.2 and 0.5 $g/cm^3$. For example, a medium size pair of pantyhose currently available in today's marketplace having a folded, uncompressed density of 0.08 $g/cm^3$ that is compressed 4 times in accordance with the present invention will be packaged to a compressed density of 0.32 $g/cm^3$. Of course, with a relatively high density associated with the hosiery item 4 in the uncompressed state, a lower percentage of change in density of the hosiery item 4 will occur during packaging in accordance with the invention given the desired compressive forces applied. Again, the particular density range of the packaged pantyhose or other hosiery item will vary depending upon various factors including the particular size of the pantyhose and the packaging size. In accordance with the present invention, the preferred density of the compressed pantyhose is between 2 to 12 times that of the loosely folded uncompressed pantyhose and preferably between 3 to 6 times.

At this point it should be readily obvious that the particular shape and material associated with package 2 can vary without departing from the spirit of the invention. In addition, although the invention has particular applicability of packaging a pair of pantyhose, it should be readily understood that all of the embodiments described are equally applicable to compressively packaging various types of hosiery including ankle, knee and thigh-high stockings and the like.

The apparatus for packaging hosiery items as illustrated in FIGS. 4–7 includes a guide and support member 20 that is preferably formed from a rigid, metal or plastic material. Guide and support member 20 includes a generally planar supporting portion 22 and a generally funnel-shaped portion 25. More specifically, supporting portion 22 is generally planar and includes an opening 27 which leads to funnel-shaped portion 25. Funnel-shaped portion 25 is defined by an annular, sloping upper wall portion 30 and an elongated tubular portion 32. Intermediate its length, tubular portion 32 is provided with a plurality of spaced apertures 35 and 36.

The packaging apparatus of FIGS. 4–7 also includes a lifting unit generally indicated at 40. Lifting unit 40 is constituted by a linear actuator that can be pneumatic, hydraulic or even electrical in nature. In the preferred embodiment, lifting unit 40 comprises a pneumatic actuator including a cylinder portion 42 and an extendable shaft portion 44. Since the specific construction and manner of operation of lifting unit 40 is well known in the art, it will not be further discussed herein in detail. Extendable shaft portion 44 includes a remote end that carries a package support member 47. In this embodiment, package support member 47 includes an upper concave-shaped recess 49 which conforms to the bottom end and a portion of the sides of package 2. The packaging apparatus further includes a loading unit 54 that is adapted to be linearally shifted along an axis substantially parallel to a plane defined by supporting portion 22 of guide and support member 20 by any means known in the art such as an additional linear actuator. Loading unit 54 includes telescoping loading and compression members 57 and 59. The specific operation of loading unit 54 in connection with the packaging of hosiery item 4 will be discussed more fully below, however, at this point it should be noted that loading member 57 and compression member 59 are adapted to selectively telescope into and out of tubular portion 32.

Finally, the packing apparatus represented in these figures includes a pair of opposing sealing units 63 and 64. Each sealing unit 63, 64 includes an upper telescoping ram member 67 and a lower telescoping ram member 68. Upper and lower telescoping ram members 67, 68 are adapted to selectively extend and retract from within housings 71 and 72 of sealing units 63 and 64 respectively. The upper telescoping ram member 77 projecting from housing 71 includes a flat terminal end 67 and is directly opposed to a flat terminal end 78 of the upper telescoping ram member 67 projecting from housing 72. These upper telescoping ram members 67 are adapted to extend into close abutment in order to pinch a package positioned therebetween in order to seal the package in a manner more fully discussed below. On the other hand, lower telescoping ram members 68 projecting from housings 71 and 72 respectively are formed with angled terminal ends 81 and 82 respectively. Lower telescoping ram members 68 function to retain hosiery 4 within a package during sealing of package by upper telescoping ram members 67 as will be more fully discussed below.

Figure 4:
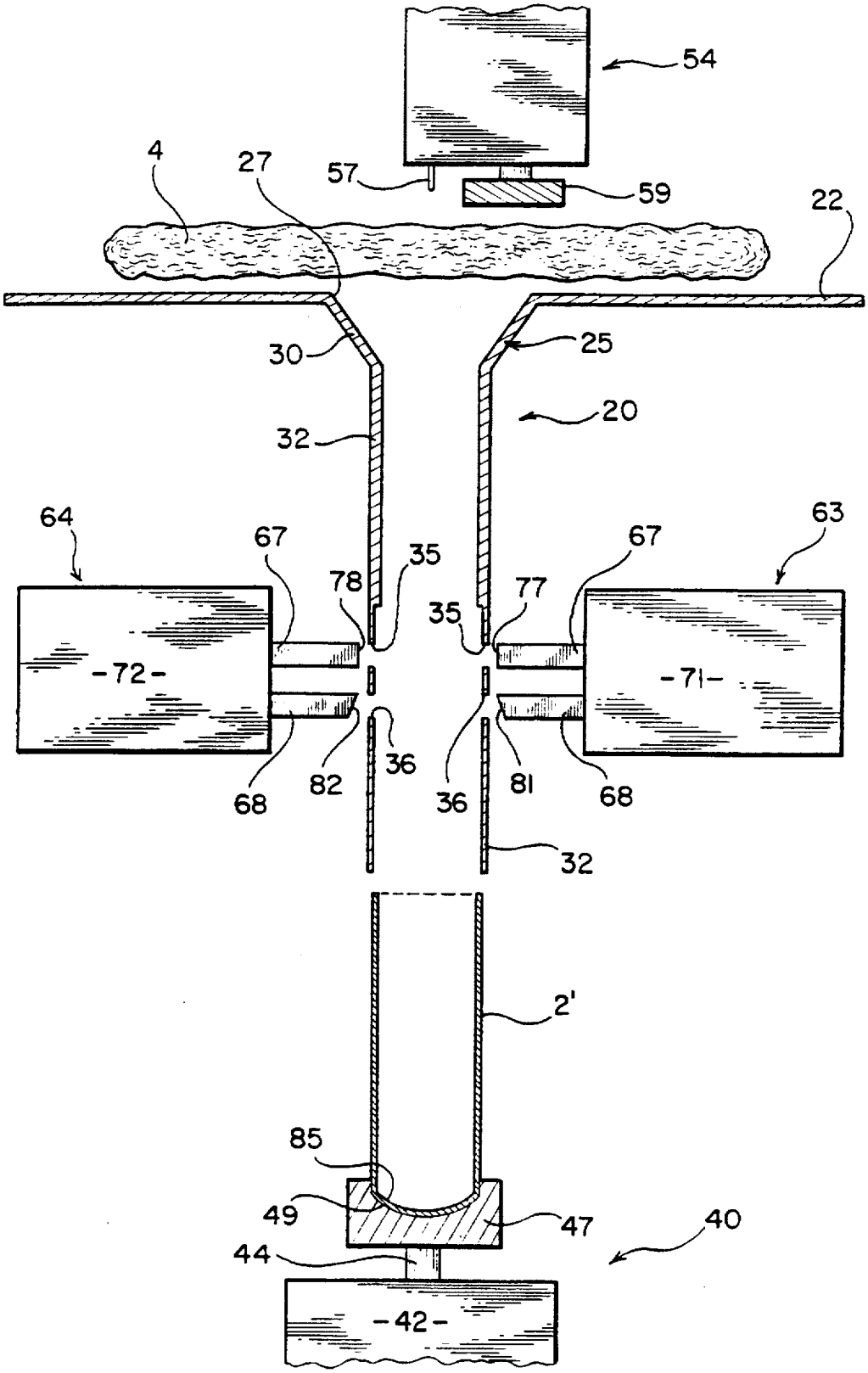
FIG. 4 is a schematic view of an apparatus for packaging a hosiery item in accordance with the present invention during an initial operation stage.
Figure 5:
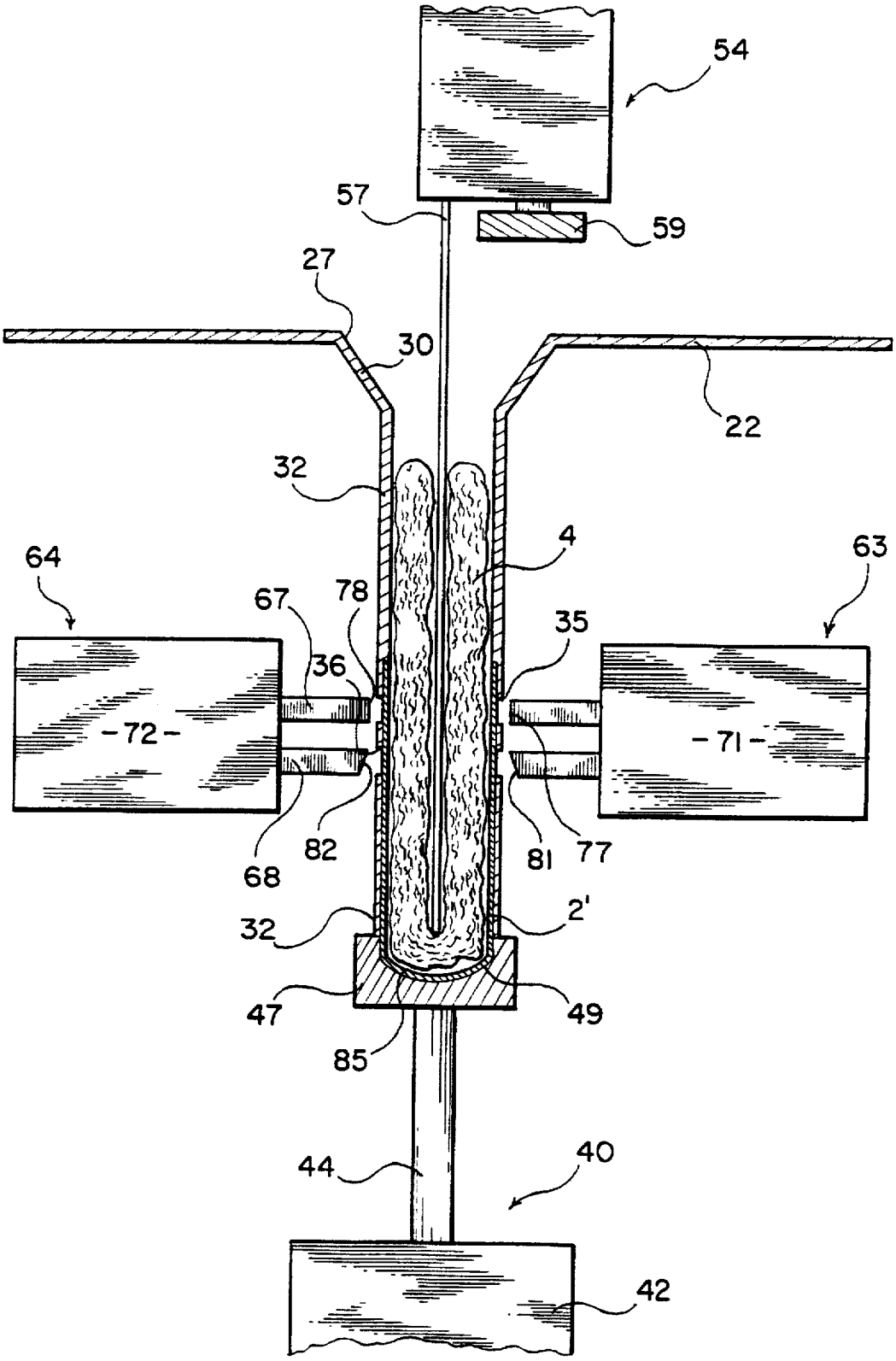
FIG. 5 is a schematic view of the apparatus of FIG. 4 in a secondary, loading stage.

The operation of the packaging apparatus depicted in FIGS. 4–7 will now be described. It should be evident that this apparatus can be used to form a package as illustrated in FIGS. 1–3, however, FIGS. 4–7 indicate the use of a package 2' having a convexly curved integral bottom 85. Initially, hosiery item 4 is positioned upon support portion 22 and loading unit 54 is shifted such that loading member 57 is aligned with a central longitudinal axis of tubular portion 32. In addition, as illustrated in FIG. 4, upper and lower telescoping ram members 67 and 68 are fully retracted. At this point, lifting unit 40 is activated to cause extendable shaft portion 44 to lift package 2' upward to within tubular portion 32. Package 2' is lifted beyond apertures 35 and 36 as best illustrated in FIG. 5. Immediately following this operation or concurrent therewith, loading member 57 is actuated so as to force hosiery item 4 into tubular portion 32 and package 2' through funnel shaped portion 25. At this stage, the apparatus assumes the position shown in FIG. 5.

Figure 6:
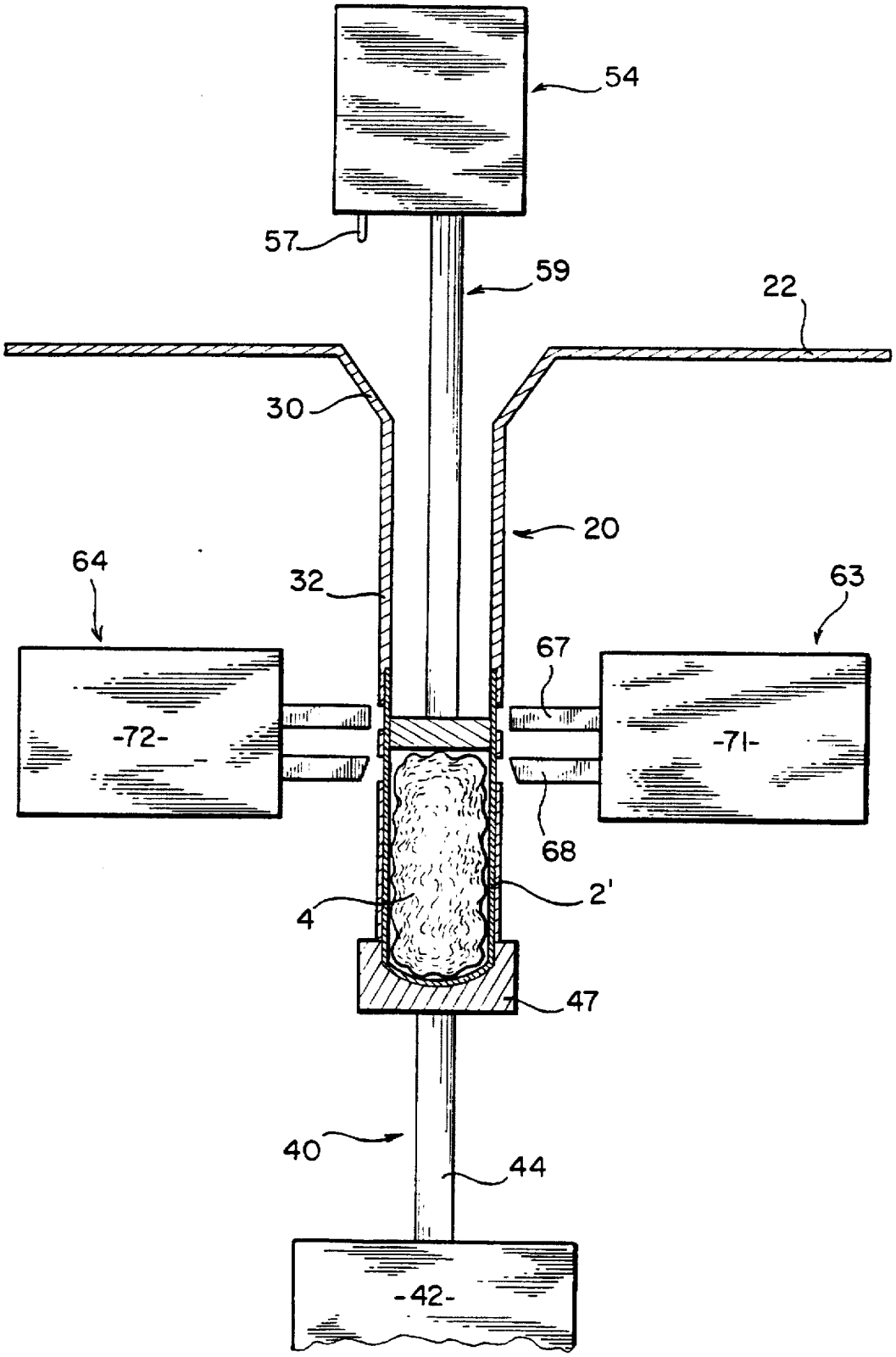
FIG. 6 is a schematic view of the apparatus of FIGS. 4 and 5 in a compression stage.
Figure 7:
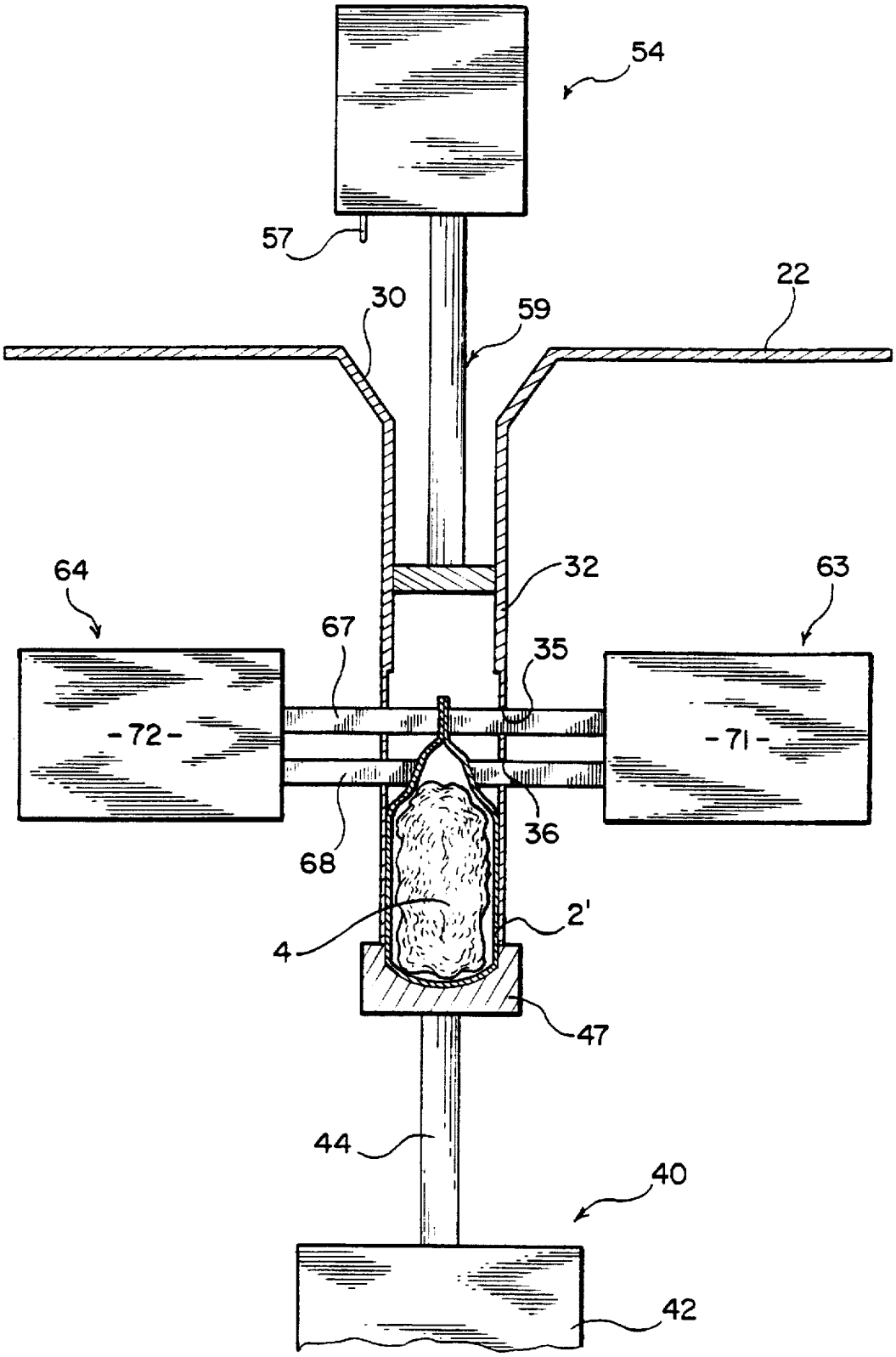
FIG. 7 is a schematic view of the packaging apparatus of FIGS. 4–6 in a package sealing stage of operation.

After loading member 57 is fully extended, it is then retracted from within guide and support member 20 and loading unit 54 is shifted to the position illustrated in FIG. 6 wherein compression member 59 is aligned with the longitudinal axis of tubular portion 32. Compression member 59, which basically constitutes a plunger, is then extended within tubular portion 32 and package 2'. Loading unit 54 is designed to apply a compressive force between 20 to 50 psi to hosiery item 4 within package 2' thereby causing hosiery item 4 to be compressed and its density substantially increased. Once the desired compression of hosiery item 4 is achieved by compression member 59, lower telescoping ram members 68 are extended through apertures 36 and compression member 59 is retracted. Extension of lower telescoping ram members 68 causes package 2' to shift inwardly as illustrated in FIG. 7 so as to push against hosiery item 4 thereby maintaining hosiery item 4 in its desired, compressed state. After compression member 59 retracts beyond upper telescoping ram members 67, upper telescoping ram member 67 are extended through apertures 35 and pinch the upper end (not labeled) of package 2' in order to seal package 2'.

The exact manner in which upper telescoping ram member 67 seals package 2' can vary in accordance with the present invention. In the preferred embodiment, an upper inside surface of package 2' has been previously coated with an adhesive and upper telescoping ram members 67 constitute heating elements which melt the adhesive while securely pressing the end portions together. Of course, various other arrangements could also be utilized. For instance, flat ends 76 and 78 could also be configured so as to crimp the upper ends of package 2'.

Once package 2' is sealed, upper and lower telescoping ram members 67 and 68 are withdrawn through apertures 35 and 36 respectively from within tubular portion 32 and extendable shaft portion 44 of lifting unit 40 is retracted within cylinder portion 42 such that package 2' is fully withdrawn from within tubular portion 32. At this point, package 2' can be removed from package support member 47 and the process can be repeated.

Figure 8:
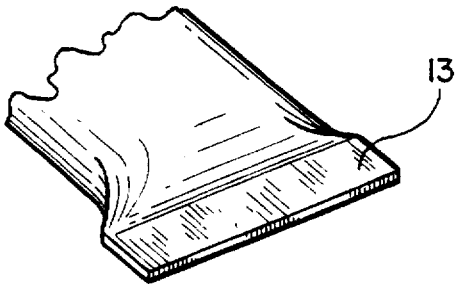
FIG. 8 is an exploded view of a packaging arrangement in accordance with a second preferred embodiment of the invention.
Figure 8:
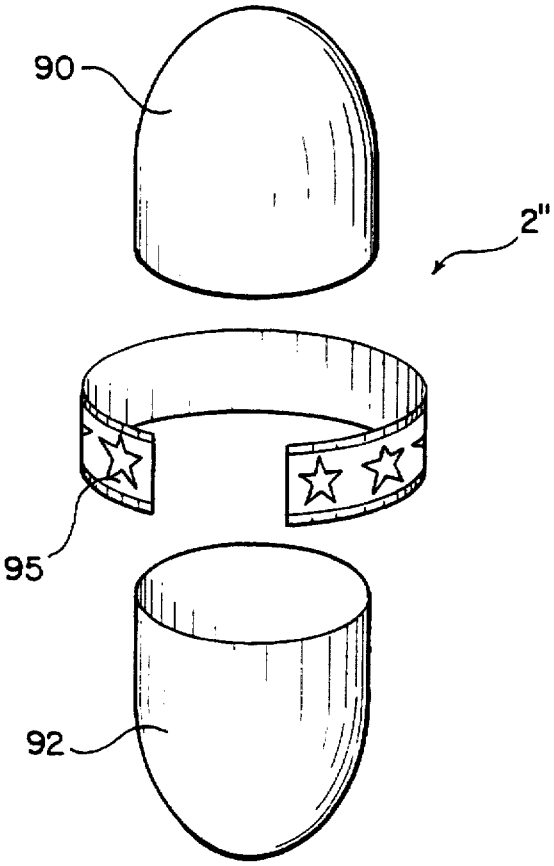
Figure 9:
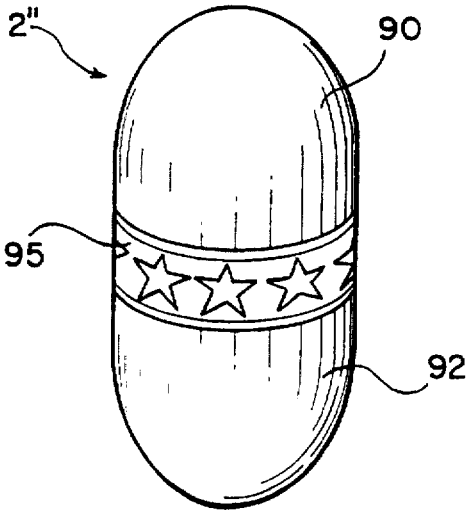
FIG. 9 illustrates an assembled hosiery package in accordance with the embodiment of FIG. 8.

FIGS. 8–12 depict a third package generally indicated at 2" as well as an apparatus for packaging hosiery item 4 within package 2". More specifically, FIG. 8 is an exploded view of package 2" which includes an upper shell 90 and a lower shell 92. Upper and lower shells 90 and 92 preferably have rounded ends as clearly depicted in FIG. 8 and are adapted to be secured together by means of an adhesive strip 95 such that package 2" assumes the general shape shown in FIG. 9 when assembled with adhesive strip 95 being indicated to have some type of ornamental design thereon. Although the particular material used to form package 2" can vary, in the preferred embodiment, package 2" is made from a thermoplastic material.

Specific reference will now be made to FIGS. 10–12 in describing the structure and apparatus used to package a hosiery item 4 in package 2". As indicated above, like reference numerals have been used to refer to the corresponding parts described above with respect to the apparatus embodiment of FIGS. 4–7. In general, lifting unit 40' is substantially identical to lifting unit 40 disclosed above with respect to the embodiment of FIGS. 4–7, however, package support member 47' is shown configured differently at 49' in order to conform to the specific shape of lower shell 92. In addition, it should be noted that in this embodiment, tubular portion 32' is not provided with corresponding apertures 35 and 36 as these apertures are no longer needed since sealing unit 63 and 64 are not utilized in connection with this apparatus due to the different manner of sealing package 2" as compared to package 2'.

Figure 10:
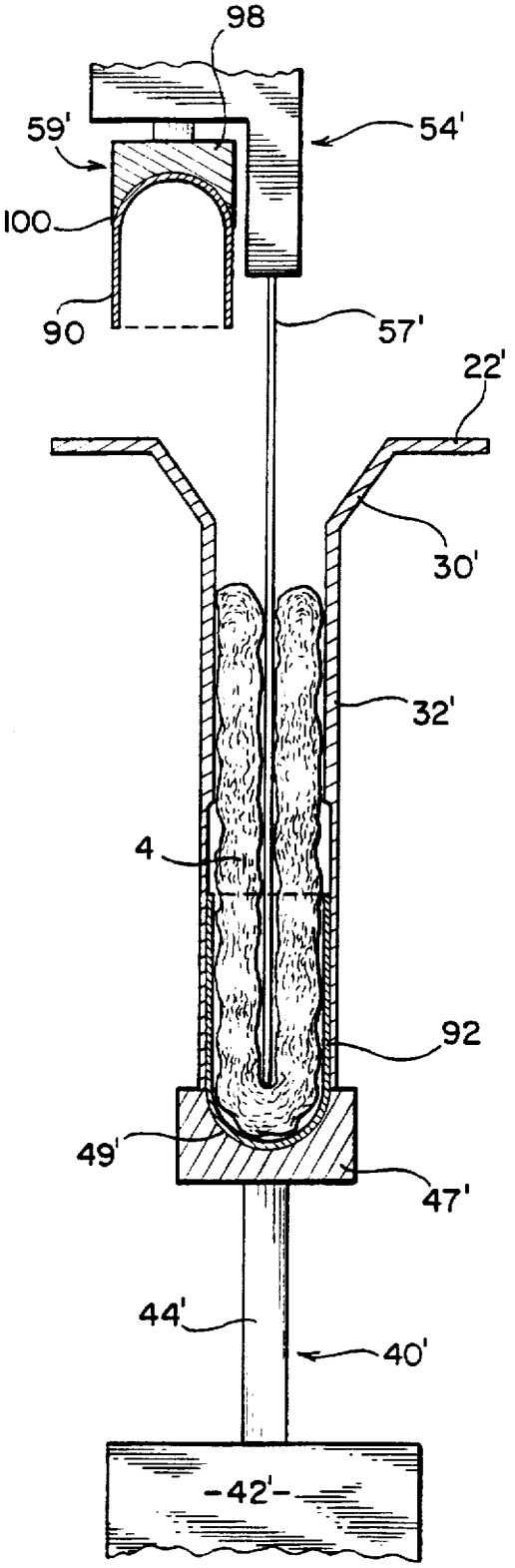
FIG. 10 is a schematic view of an apparatus for packaging a hosiery item in the package depicted in FIGS. 8 and 9 during an initial loading stage.
Figure 11:
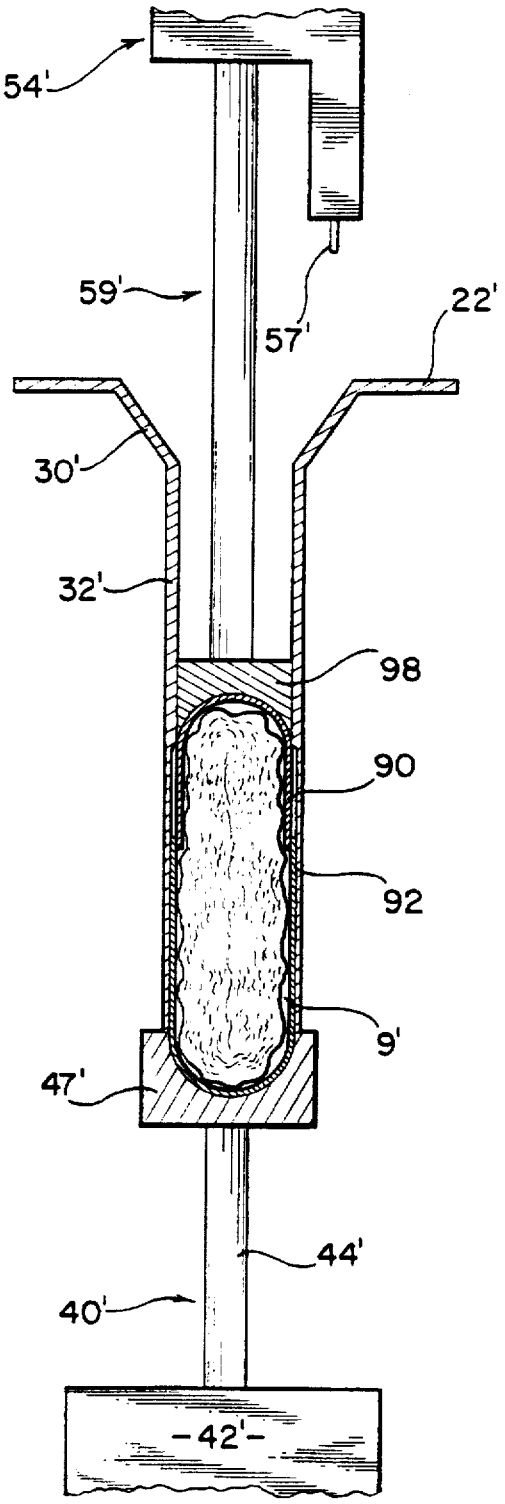
FIG. 11 schematically illustrates the manner in which a hosiery item is compressably packaged within the packaging arrangement of FIG. 10.
Figure 12:
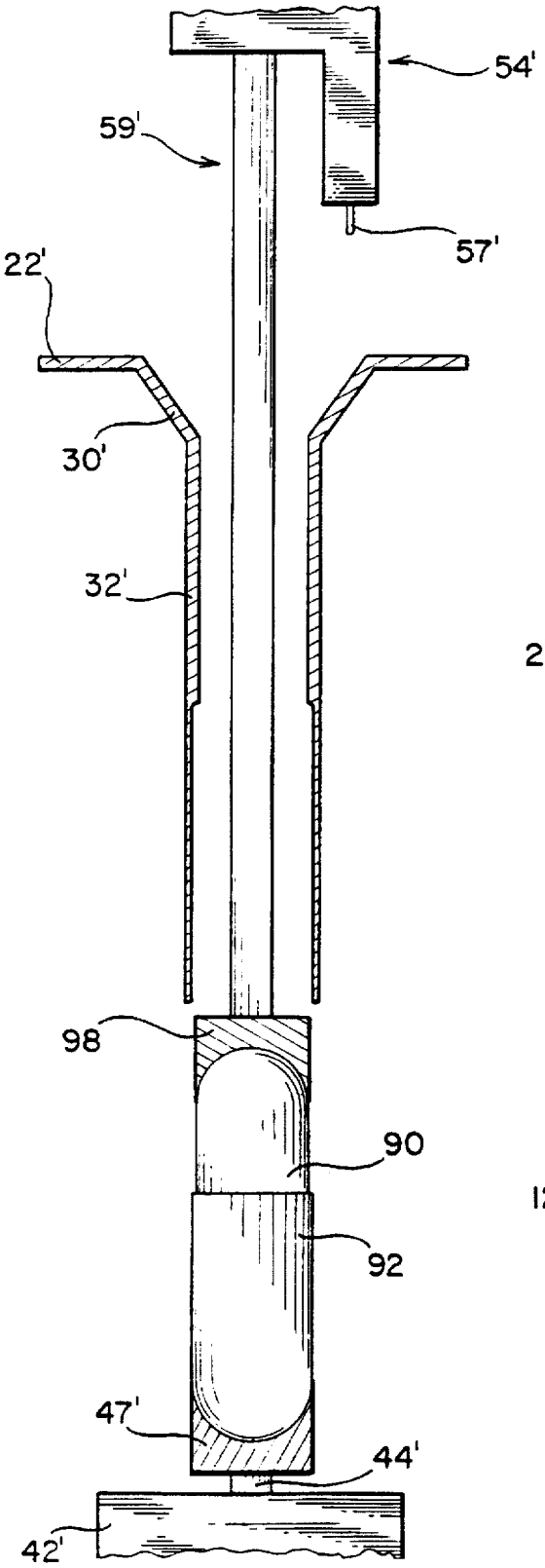
FIG. 12 is a schematic view of the apparatus of FIGS. 9 and 10 illustrating the manner in which the packaged hosiery item is removed.

According to the embodiment of FIGS. 10–12, once lifting unit 40' shifts lower shell 92 to within tubular portion 32', loading member 57' of loading unit 54' is shifted in a manner directly analogous to that of the above-described embodiment in order to provide an initial packing of hosiery item 4 within lower shell 92. Loading unit 54' differs from loading unit 54 in that it is provided with a compression member 59' that includes an upper shell support member 98 that is shaped to receive upper shell 90. Upper shell support member 98 is preferably provided with an annular extension 100 which is adapted to frictionally retain upper shell 90 as shown in FIG. 10. Of course other arrangements could also be utilized to retain upper shell 90 to upper shell support member 98 such as the application of an adhesive or the selective application of a vacuum therebetween.

After loading member 57' is fully retracted, loading unit 54' is shifted to position shown in FIG. 11 and compression member 59' is extended while still retaining upper shell 90. The diameter of upper shell 90 is designed slightly smaller than lower shell 92 such that upper shell 90 can be received within lower shell 92. Unless either upper or lower shells 90, 92 are slightly porous, a hole (not shown) is provided to enable the escape of air as upper shell 92 is shifted downward. Again, compression member 59 is adapted to apply compressive force between 1.4 to 3.5 kg/cm$^2$ (20–50 psi) in order to compress hosiery item 4 the desired amount within the storage chamber 9' defined within upper and lower shells 90 and 92. At this stage, compression member 59' continues to extend with simultaneous retraction of extendable shaft portion 44' of lifting unit 40' until package 2" assumes the position shown in FIG. 12. In this position, adhesive strip 95 or other means known in the fastening art for interconnecting upper and lower shells 90 and 92 can be applied. After upper and lower shells 90 and 92 are secured together, compression member 59' is fully retracted, package 2" is removed from upon package support member 47' and the apparatus is ready to repeat its operation.

Figure 13:
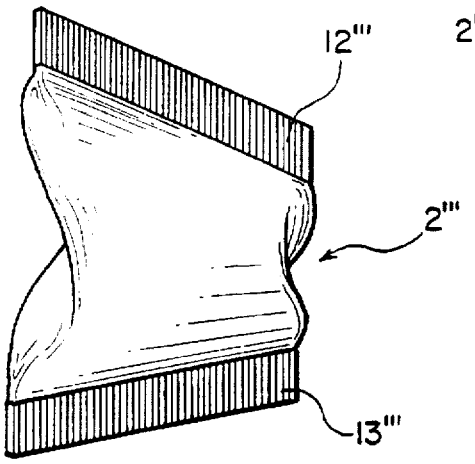
FIG. 13 is a perspective view of a packaging arrangement in accordance with a third preferred embodiment of the invention.

FIG. 13 represents an alternative package 2'" for hosiery item 4. The package of FIG. 13 can be formed in a manner substantially identical to that described above with respect to FIGS. 4–7 but with the upper and lower ends 12'" and 13'" of the package being sealed, either through adhesive, crimping or otherwise, at right angles to each other.

Figure 14:
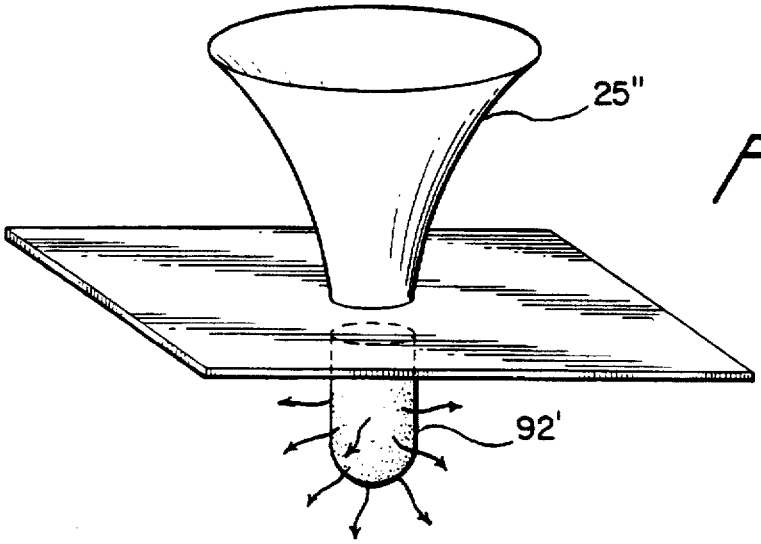
FIG. 14 schematically illustrates a third preferred packaging apparatus in accordance with the present invention.

FIG. 14 discloses a packaging arrangement substantially similar to that disclosed with reference to FIGS. 10–12, however, the lower shell 92' is porous and a high pressure air source (not shown) is used to load a hosiery item within funnel-shaped portion 25". A vacuum is also preferably applied at lower shell 92' to compress the hosiery item while the package is sealed.

Figure 15A:
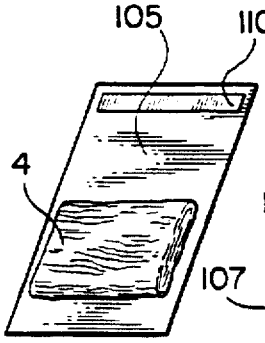
FIG. 15A illustrates an initial stage of a fourth packaging arrangement in accordance with the present invention.
Figure 15B:
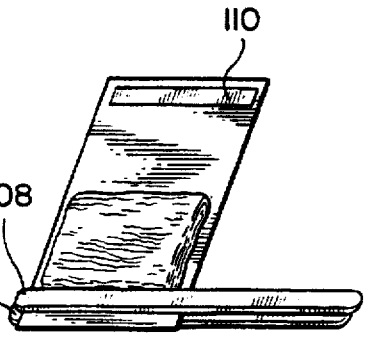
FIG. 15B illustrates a second stage of the packaging arrangement of FIG. 15A.
Figure 15C:
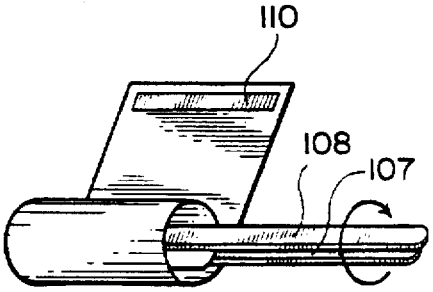
FIG. 15C illustrates the manner in which a hosiery item is compressed in accordance with the packaging arrangement of FIGS. 15A and 15B.

FIGS. 15A–15C represent another packaging arrangement in accordance with the present invention. According to this embodiment, hosiery item 4 is placed upon a packaging sheet 105. Packaging sheet 105 then is positioned between a pair of leg members 107 and 108 of a rolling device. Leg members 107 and 108 are then rotated simultaneously to cause packing sheet 105 to roll up while simultaneously compressing hosiery item 4. Packaging sheet 105 is preferably formed with an adhesive strip 110 which can be used to seal packaging sheet 105 to itself once packaging sheet 105 is fully rolled.

Figure 16A:
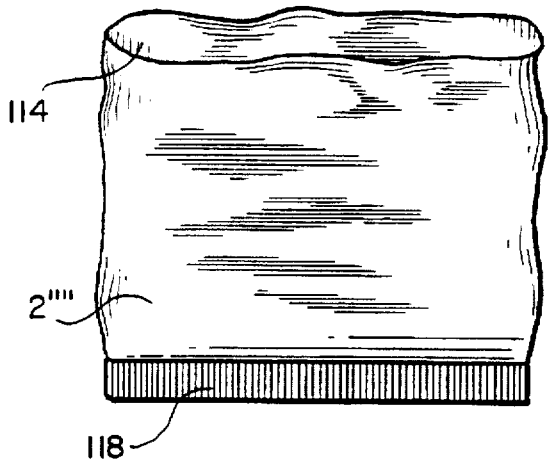
FIG. 16A illustrates a packaging arrangement in accordance with a still further embodiment of the invention.
Figure 16B:
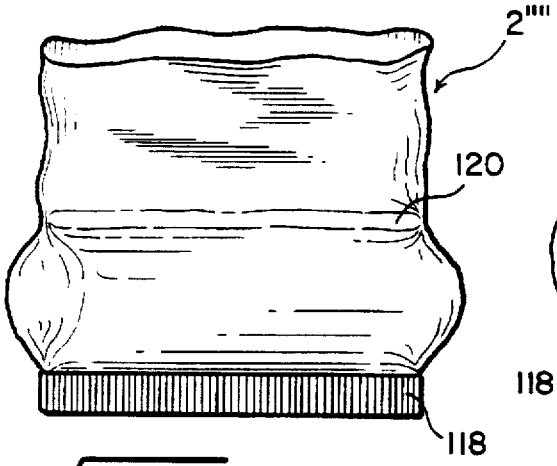
FIG. 16B illustrates the packaging arrangement of FIG. 16A after compressably sealing a hosiery item therein.
Figure 16C:
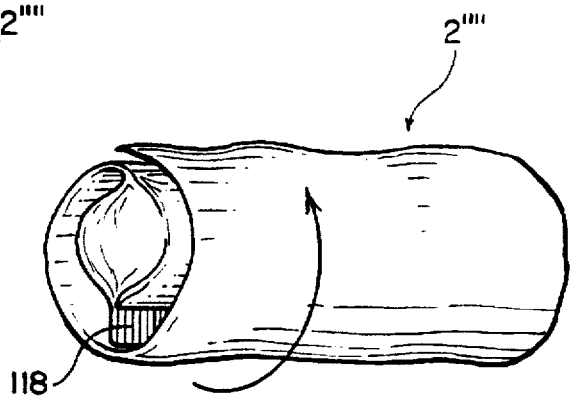
FIG. 16C represents the final processing step in accordance with the packaging arrangement of FIG. 16A and 16B.

FIGS. 16A–16C disclose another applicable sealing embodiment. According to this embodiment of the invention, a hosiery item is inserted within a storage chamber 114 of a package or container 2"" having a sealed bottom edge 118. A vacuum source (not shown) then applies a vacuum to within storage chamber 114 which causes the hosiery item to be shifted into the lower half portion of package 2"" (see FIG. 16B). In this preferred embodiment, package 2"" constitutes a plastic bag which is then heat sealed along line 120. Thereafter, the top half of package 2"" can be rolled around and attached to the lower half to complete the packaging operation (see FIG. 16C).

Figure 17B:
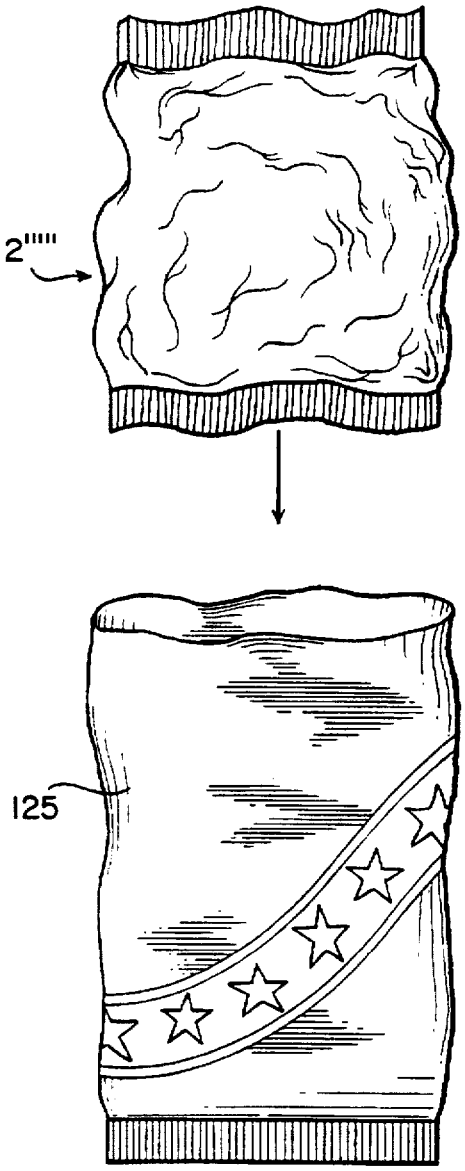
FIG. 17B depicts the packaging arrangement of FIG. 17A in a compressed state.
Figure 17A:
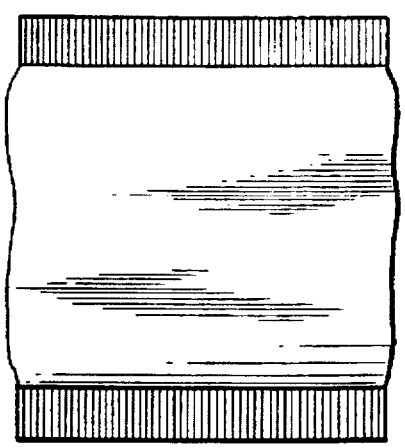
FIG. 17A illustrates another potential packaging arrangement for the packaging container of FIG. 16A.

FIGS. 17A and 17B disclose a still further packaging arrangement for hosiery in accordance with the present invention. According to this embodiment, a hosiery item would be placed within container or package 2"" and then the package would be sealed at both ends. Following sealing of the package, the package would be heat shrunk in order to compress the hosiery item. Finally, package 2"" can be inserted within an outer bag 125, which itself would be sealed. Outer bag 125 would basically only be presented for aesthetic purposes.

Figure 18:
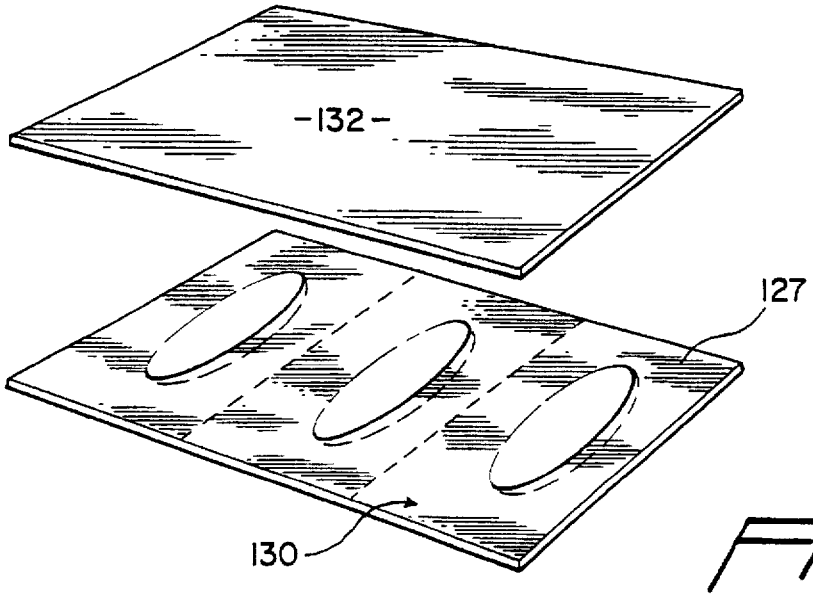
FIG. 18 represents a still further potential packaging arrangement for hosiery items in accordance with the present invention.

Finally, FIG. 18 depicts a still further potential packaging arrangement for hosiery items in accordance with the present invention. In accordance with this embodiment, a lower preformed plastic sheet 127 would be formed with a plurality partial storage chamber defining structures, one of which is generally indicated at 130. A similarly constructed upper preform plastic sheet 132 would also be provided. The upper and lower preformed plastic sheets 127 and 132 would then be heat sealed together while vacuum packing a separate hosiery item in each of the storage chamber defining structures 130.

Although described with respect to preferred embodiments of the invention, it should be readily understood that various changes and/or modifications can be made to the invention without departing from the spirit thereof. In general, although preferred apparatuses for compressing and packaging hosiery items in accordance with the present invention have been disclosed, it should be noted that various other known types of packaging arrangements could be utilized. It is only important to note that the pantyhose items are compressed at a level of 1.4–3.5 kg/cm$^2$ (20–50 psi) in order to achieve a increase in density of the hosiery item within a storage chamber defined by the package to a compressed density of preferably 3–6 times the uncompressed loose density associated with the hosiery item. It has been found that utilizing this compression level so as to achieve this change in density does not harm the delicate material from which hosiery items are made, while still presenting a substantial decrease in the packaging size associated with such known hosiery items and enabling the hosiery to readily assume a useable state upon opening of the packaging. In general, the invention is only intended to be limited by the scope of the following claims.

I claim:

1. A compact hosiery package comprising:

a container defining a closed storage chamber having a predetermined volume; and a hosiery item having an associated uncompressed loose density, said hosiery item being compressed within said storage chamber to a compressed density corresponding to 2 to 12 times said associated uncompressed loose density.

2. A compact hosiery package as claimed in claim 1, wherein said hosiery item is compressed within said storage chamber to a density range between 0.2–0.5 g/cm$^3$ from an uncompressed loose density of 0.05–0.12 g/cm$^3$.

3. A compact hosiery package as claimed in claim 1, wherein said compressed density to which said hosiery item is compressed within said storage chamber is between 3 to 6 times said associated uncompressed loose density.

4. A compact hosiery package as claimed in claim 3, wherein the predetermined volume of said storage chamber is within the range of 30–60 cm$^3$.

5. A compact hosiery package as claimed in claim 1, wherein said container has an associated length of 5–10 cm and an associated width that is less than half said associated length.

6. A compact hosiery package as claimed in claim 1, wherein said container is made from an essentially unstretchable material.

7. A compact hosiery package as claimed in claim 1, wherein said material comprises cardboard.

8. A compact hosiery package as claimed in claim 1, wherein said hosiery item comprises a pair of pantyhose.

9. A method of packaging hosiery comprising:

compressing a hosiery item having an associated uncompressed, loose density to a compressed density corresponding to 2 to 12 times said loose density; and maintaining the hosiery item compressed by means of packaging.

10. A method of packaging hosiery as claimed in claim 9, further comprising:

providing a container defining a storage chamber;

compressing the hosiery item into said storage chamber; and closing said storage chamber to retain said hosiery item in a compressed state.

11. A method of packaging hosiery as claimed in claim 10, wherein during the step of compressing said hosiery item into said storage chamber, said hosiery item is compressed to a density of between 0.2 and 0.5 g/cm$^3$.

12. A method of packaging hosiery and claimed in claim 10, wherein the step of compressing the hosiery item comprises applying a compressive force to the hosiery item between 1.4 and 3.5 kg/cm$^2$.

13. An apparatus for packaging hosiery within a storage chamber defined within a container comprising:

means for supporting the container;

means for delivering a hosiery item to the storage chamber;

means for compressing the hosiery item within said storage chamber from an uncompressed, loose density state to a compressed density state wherein said compressed density state is 2 to 12 times said uncompressed, loose density state; and means for closing the storage chamber to maintain the hosiery item within said compressed density state.

14. An apparatus as claimed in claim 13, wherein said delivering means includes means for guiding the hosiery item toward said supporting means.

15. An apparatus as claimed in claim 14, wherein said guiding means comprises a funnel member.

16. An apparatus as claimed in claim 15, wherein said compressing means comprises a plunger that is adapted to extend through and retract from within said funnel member.

17. An apparatus as claimed in claim 13, wherein said compressing means comprises a plunger.

18. An apparatus as claimed in claim 13, wherein said compressing means develops a compressive force of between 1.4 to 3.5 kg/cm$^2$.

19. An apparatus as claimed in claim 13, wherein said closing means includes means for sealing said storage chamber.

20. An apparatus as claimed in claim 19, wherein said closing means further comprises means for retaining the hosiery item within said container during operation of said sealing means, said retaining means being distinct from said sealing means.

* * * * *